US007962983B2

(12) United States Patent
Keesaer et al.

(10) Patent No.: US 7,962,983 B2
(45) Date of Patent: Jun. 21, 2011

(54) UNIVERSAL EVACUATION POD

(75) Inventors: John Keesaer, Louisville, KY (US); Paul Kimbel, Dover, TN (US)

(73) Assignee: Evacucorp. Inc. KY (US)

( * ) Notice: Subject to any disclaimer, the term of this patent is extended or adjusted under 35 U.S.C. 154(b) by 228 days.

(21) Appl. No.: 12/320,859

(22) Filed: Feb. 6, 2009

(65) Prior Publication Data

US 2010/0199434 A1 Aug. 12, 2010

(51) Int. Cl.
*A47B 1/00* (2006.01)

(52) U.S. Cl. ..... 5/627; 5/628; 5/694

(58) Field of Classification Search ..... 5/625, 627, 5/628, 630, 632, 417, 420, 690, 691, 694, 5/703, 706, 707, 709, 710, 712, 713, 715, 5/722, 424, 425, 427–430, 739, 621, 308, 5/639, 644, 732, 945, 946, 81.1 R, 81.1 T; 441/40–42, 92, 125, 129

See application file for complete search history.

(56) References Cited

U.S. PATENT DOCUMENTS

| | | | | |
|---|---|---|---|---|
| 4,833,457 | A * | 5/1989 | Graebe, Jr. | 340/626 |
| 5,249,321 | A * | 10/1993 | Graf | 5/494 |
| 5,386,604 | A * | 2/1995 | Ricketts | 5/625 |
| 5,568,663 | A * | 10/1996 | Brown | 5/628 |
| 7,155,766 | B1 * | 1/2007 | Gilchrest et al. | 5/732 |
| 7,340,785 | B2 * | 3/2008 | Weedling et al. | 5/81.1 R |
| 2009/0094743 | A1 * | 4/2009 | Tanaka et al. | 5/81.1 T |

* cited by examiner

*Primary Examiner* — Robert G Santos
*Assistant Examiner* — Nicholas Polito
(74) *Attorney, Agent, or Firm* — H. Jay Spiegel

(57) ABSTRACT

A universal evacuation pod is deployed either from a storage location on top of a mattress of a bed or from a canister mounted on a wall. The pod includes straps to hold it in place on top of a mattress, and a chamber accessible by opening opposed side zippers which, when open, facilitate access to portions of the pod that are laterally deployed in advance of inflation. The pod is inflated by a small gas cylinder. The portions of the pod pulled laterally outwardly from the chamber include straps that may be pulled over a person between them to hold the person in place. They may also include handles allowing the pod to be easily gripped for transport. Additional straps may be provided to facilitate carrying or dragging the inventive pod.

14 Claims, 9 Drawing Sheets

UNIVERSAL EVACUATION POD

BACKGROUND OF THE INVENTION

The present invention relates to a universal evacuation pod. In the prior art, evacuation devices are well known. A variety of stretchers, slings and other apparatuses are well known for use to facilitate emergency evacuation of disaster victims as well as sick and injured people. Such devices often include handles to facilitate carrying of a person, straps both for gripping the device itself or to fasten a person thereto, flexible or rigid bodies, the latter often employed where the person to be carried has spinal injuries or one or more broken limbs, and other features including padding.

Some emergency evacuation devices also include one or more inflatable chambers which when inflated provided rigidity and which when deflated facilitate easy storage since the device adopts a much smaller volume when deflated.

A need has developed for a universal evacuation device that is easily stored in a small space or an unobtrusive location and which may be easily and quickly deployed when needed to effectively effectuate evacuation of a person.

The following prior art is known to Applicant:

U.S. Published Application No. US 2003/0106155 A1 to Arai discloses an inflatable stretcher including a plurality of chambers that are inflated, described as pockets that are inflated to render the stretcher usable. As disclosed, when not in use, the patented stretcher adopts a collapsed configuration, folded into a compact unit, and disclosed as mountable to a stairwell or stored in an emergency vehicle. The Arai device also contemplates use of straps to hold a person in place within the inflatable stretcher. The present invention differs from the teachings of Arai in a number of respects including its enhanced versatility of deployment, both in a wall-mounted canister as well as flat on top of a mattress on a bed. The present invention also includes additional features including the fact that its inflatable chamber renders it buoyant and including the provision of straps, both to hold it onto a bed before use, but also to facilitate transporting it with a person strapped into it.

U.S. Pat. No. 7,216,378 to Barth et al. discloses a patient removal system in plural embodiments. One embodiment includes a complicated mechanism to handle a patient positioned on the device. Another embodiment includes use of inflatable tubes beneath a drape draped over the patient. This latter embodiment is extremely cumbersome contemplating six large elongated tubes positioned under the person to be transported. The present invention by contrast is extremely portable, versatile in its manner of storage, easy to deploy, and includes features facilitating protection of the person to be transported by inflated chambers which may also provide suitable buoyancy.

SUMMARY OF THE INVENTION

The present invention relates to a universal evacuation pod. The present invention is easy to store, easy to install in a location where it will be used, easy to deploy, and protective of a person evacuated using it. The present invention includes the following additional aspects and features:

(1) In the preferred embodiments of the present invention, it is intended to be deployed either from a storage location on top of a mattress of a bed or from a canister mounted on a wall or other location.

(2) When deployed on top of an existing mattress, the inventive pod includes a plurality of straps designed to be used to hold it in place on top of the mattress. The pod also includes a chamber accessible by opening opposed side zippers, with the chamber having a top surface that may be padded and have a sheet overlying it when the bed is being used under normal circumstances. When the zippers are open, portions of the inventive pod may easily be laterally deployed in advance of inflating the pod.

(3) In the preferred embodiments, the pod is inflated through the use of a small gas cylinder typically filled with $CO_2$ (Carbon Dioxide). In order to release the gas from the cylinder, a cord is pulled, opening a valve between the cylinder and the chambers to be inflated. A pressure relief valve regulates the amount of pressure in the pod. This valve is used to prevent overinflation and governs inflation volume.

(4) The portions of the inventive pod pulled laterally outwardly from the chamber when the zippers are opened include straps that may be pulled over a person between them to hold the person in place. They may also include handles allowing the pod to be easily gripped for transport. Additional straps may be provided to facilitate carrying or dragging the inventive pod.

(5) In the embodiment designed to be initially mounted on top of a mattress, when the device is to be used, the side zippers are opened, the portions of the pod within the chamber accessed by the zippers are pulled laterally out therefrom and pivoted upwardly, whereupon their straps are used to fasten a person thereunder. The straps holding the pod to the mattress are released from the mattress and the valve is opened allowing gas from the gas cylinder to inflate the chambers of the pod. Once they have been sufficiently inflated, the pressure relief valve prevents overinflation and governs the amount of air pressure to desired inflation level, whereupon the person may easily be transported. The chambers provide suitable buoyancy to allow the inventive pod to float, if necessary.

(6) In the embodiment initially stored in a canister, the canister is mounted in any suitable location such as, for example, on a wall. When it is desired to deploy the pod, the canister is opened and the pod is removed therefrom, and opened up on a floor surface or, if desired, on top of a bed. Once appropriately situated, a person to be transported is placed on top of the pod in any suitable manner and then the pod is inflated and the person is strapped to it, whereupon the person is suitably transported. The means to activate the pod that is initially contained in a canister may be a handle with a cord attached to it as opposed to the cord used in the embodiment initially mounted on top of a mattress on a bed.

(7) In the preferred embodiments of the present invention, the materials employed for the inventive universal evacuation pod are strong, but flexible materials such as nylon, polyurethane as well as foamed materials. In the preferred embodiment, the gas within the cylinder is Carbon Dioxide ($CO_2$). The canister designed to removably receive the evacuation pod in the wall mounted embodiment may consist of a large piece of cylindrical tubing made of a material such as polyvinylchloride (PVC) and having a removable cap, either hinged or removable by reciprocating it away from the tube.

As such, it is a first object of the present invention to provide a universal evacuation pod.

It is a further object of the present invention to provide such a universal evacuation pod in which it may be mounted initially on top of a mattress on a bed or within a canister mounted on a wall or other convenient location.

It is a still further object of the present invention to provide such a device which may be accessed and then inflated to provide both buoyancy and protection for a person to be transported.

It is a still further object of the present invention to provide such a device in which a gas cylinder releases gas into chambers formed in the pod to inflate them while a pressure relief valve precludes over-inflation.

It is a yet further object of the present invention to provide such a device that may easily be stored, may easily be deployed, and provides a safe way to facilitate transport of a person away from a dangerous area.

These and other objects, aspects and features of the present invention will be better understood from the following detailed description of the preferred embodiments when read in conjunction with the appended drawing figures.

BRIEF DESCRIPTION OF THE DRAWINGS

FIG. 9 shows the first embodiment of the present invention being transported with a person strapped in.

SPECIFIC DESCRIPTION OF THE PREFERRED EMBODIMENTS

Figure 1:
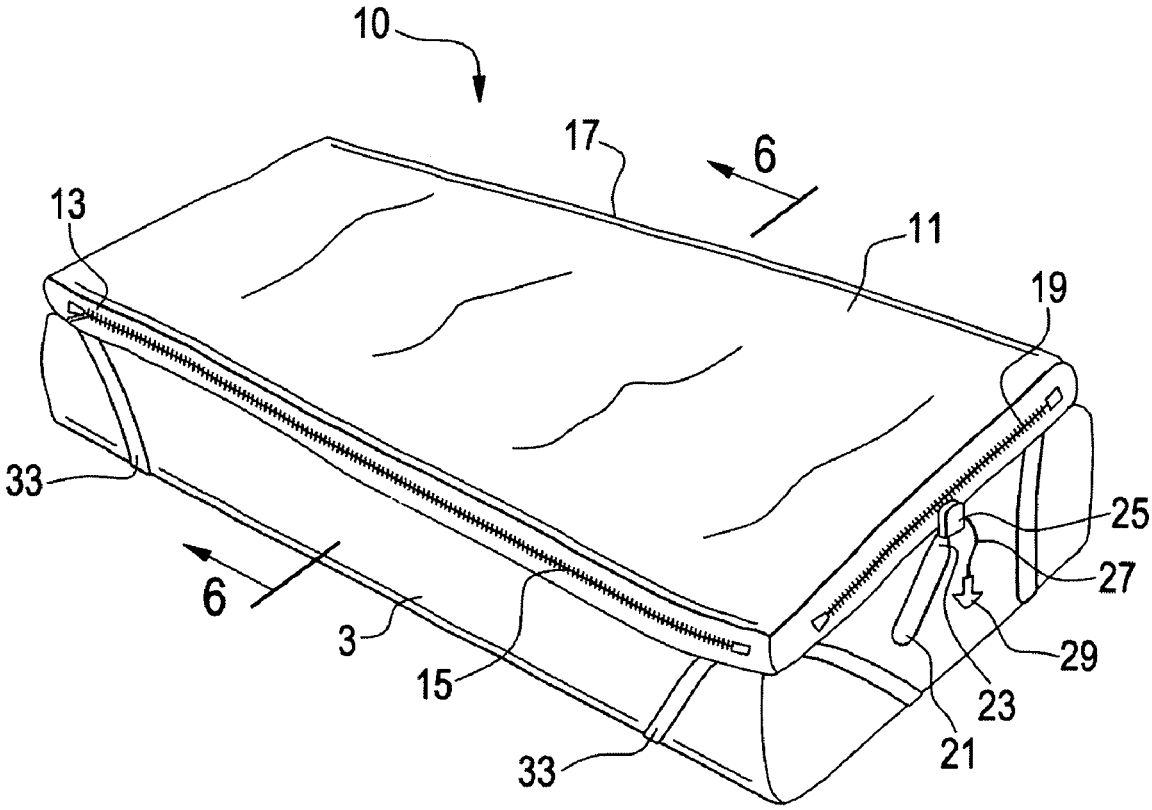
FIG. 1 shows a side perspective view of a first embodiment of the present invention as mounted on a mattress.
Figure 2:
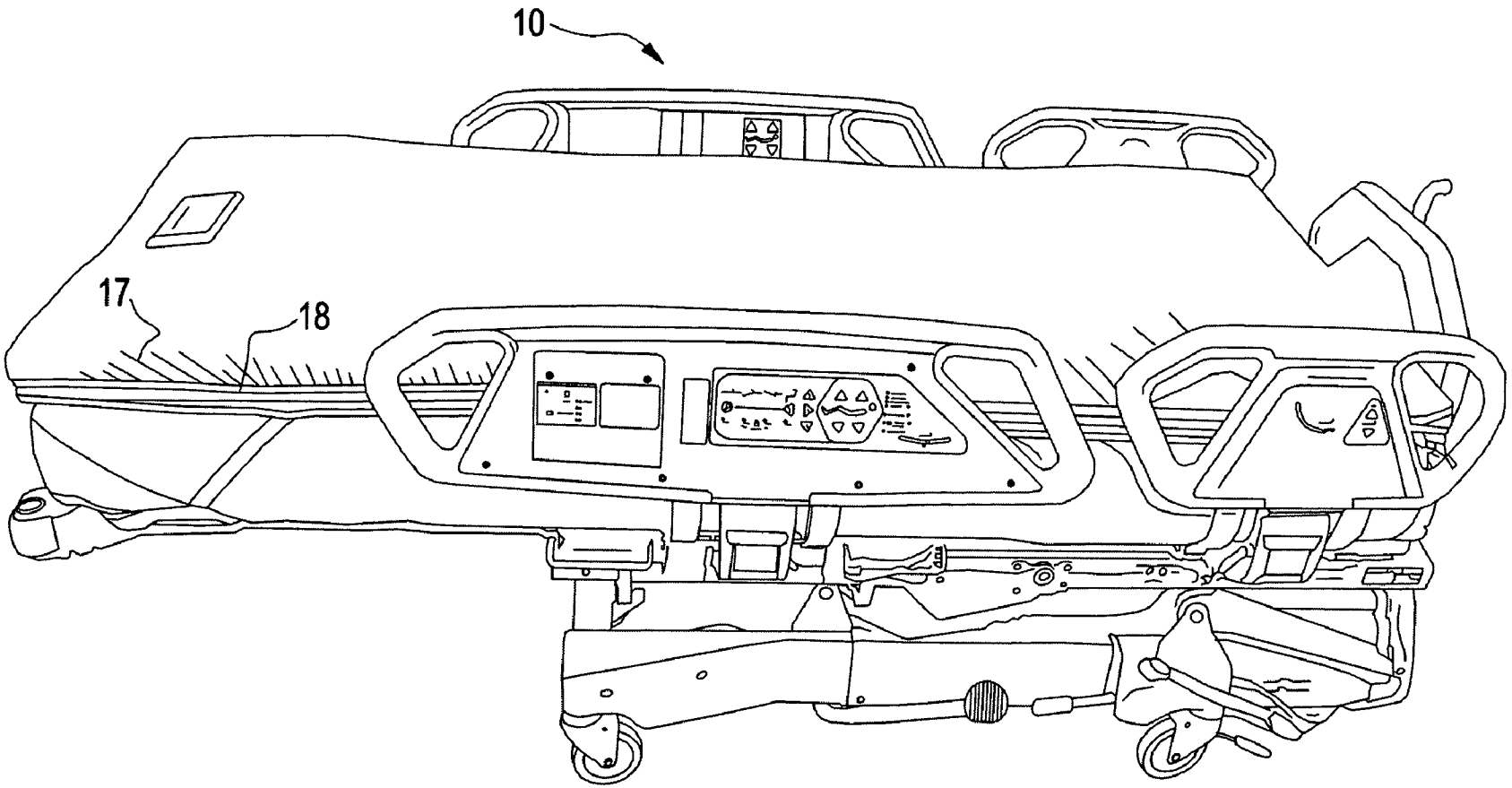
FIG. 2 shows a view from the other side of the present invention.
Figure 3:
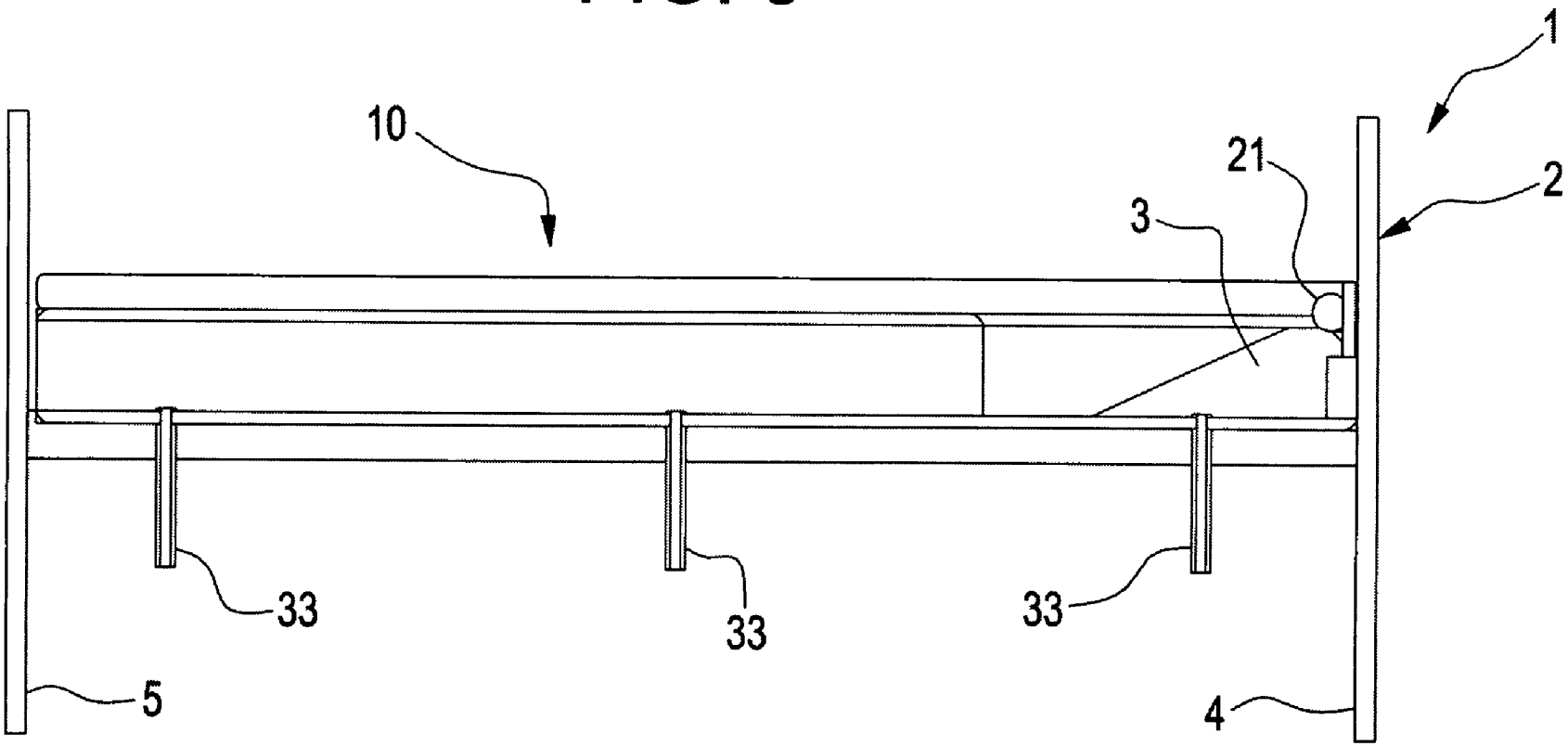
FIG. 3 shows a side view of a bed unit having a mattress thereon and the first embodiment of the present invention mounted thereover.

With reference first to FIGS. 1-11, a first embodiment of the present invention is generally designated by the reference numeral 10. With reference to FIG. 3, a bed 1 includes a frame 2 on which a mattress 3 has been placed. The frame 2 includes, for example, legs 4 and 5 to support the bed on a floor surface.

Figure 4:
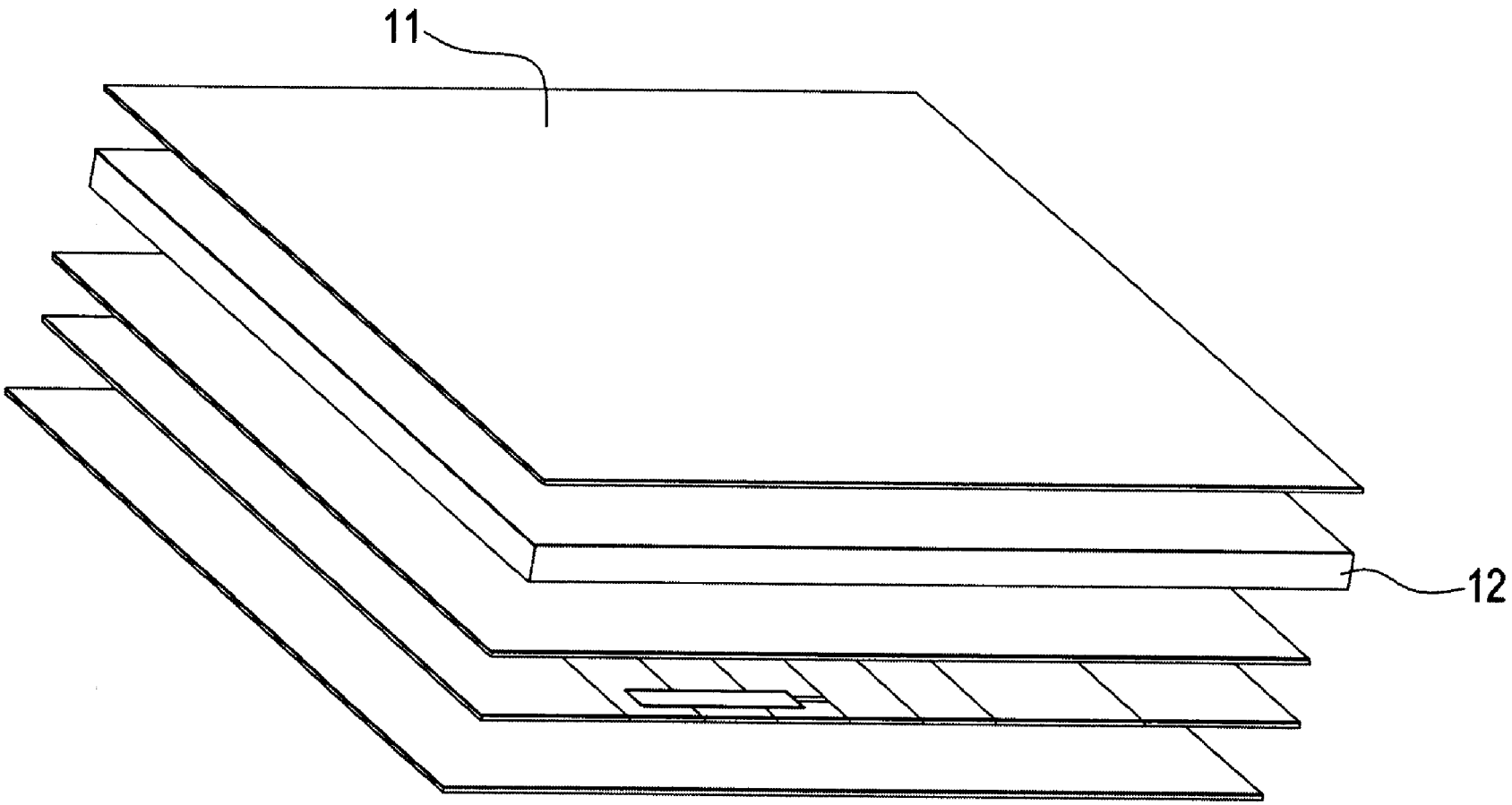
FIG. 4 shows an exploded perspective view showing the layers of the invention.
Figure 7:
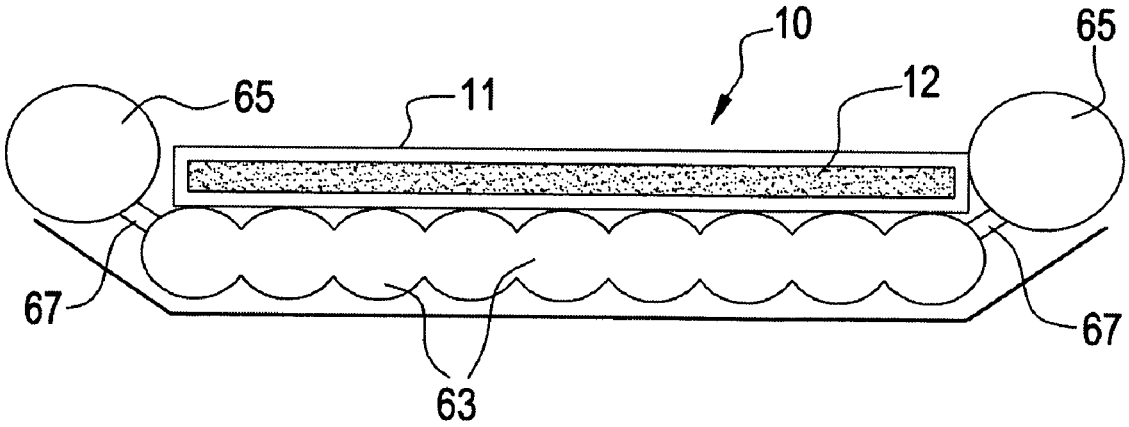
FIG. 7 shows a cross-sectional view along the line 7-7 of FIG. 5.

As shown in FIGS. 1, 4 and 7, in particular, the inventive evacuation pod has a top surface 11 that is smooth and forms the top of an enclosure containing other components of the pod 10. If desired, below the top surface cover 11 may be a layer or thickness of padding 12 (FIGS. 4, 6 and 7) so that it is more comfortable for a user to lie on top of the pod 10 as mounted on top of the mattress 3. This layer of padding 12 may comprise a pressure reduction foam pad that may be mounted on the underside of the cover 11 and accessible through the zippers including the zipper 15. As shown in FIG. 1, a side 13 of the pod 10 includes a zipper 15 which when opened allows access to the interior 22 of the pod (FIG. 6) so that components of the pod 24, 26 not shown in FIG. 1 become accessible. The other side 17 of the pod 10 includes a zipper 18 (FIG. 2) corresponding to the zipper 15 and provided for the same purpose. A further zipper 19 is located at a location corresponding to the foot of the bed 1 and when opened allows access to inflation means comprising a canister or cylinder 21 filled with pressurized gas such as, for example, Carbon Dioxide ($CO_2$). The zippers 15, 18 and 19 may be replaced by any suitable fastening means such as hook and loop fasteners, snaps, buttons or the like. The outlet 23 of the cylinder 21 connects with a valve 25 that is opened by pulling a cord 27 (FIGS. 1 and 10) having a handle 29 that may be gripped and pulled for that purpose. The valve 25 may comprise a piercing element that pierces a thin wall at the neck of the gas cylinder 21 to facilitate gas flow. Once the thin wall is pierced, all gas in the cylinder 21 is exhausted into the chambers of the pod 10.

Figure 8:
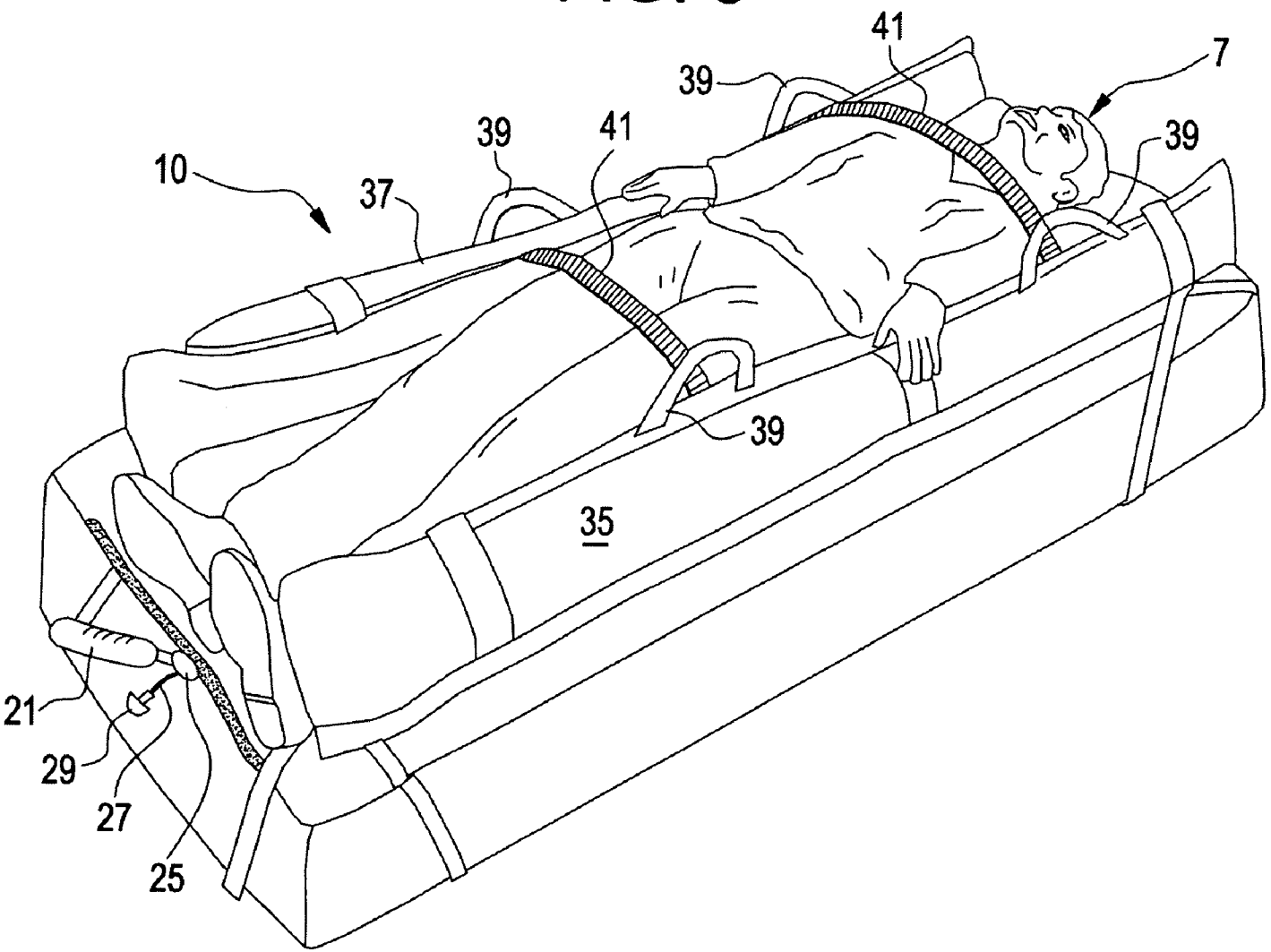
FIG. 8 shows a side perspective view of the first embodiment of the present invention as deployed while on an existing mattress.
Figure 10:
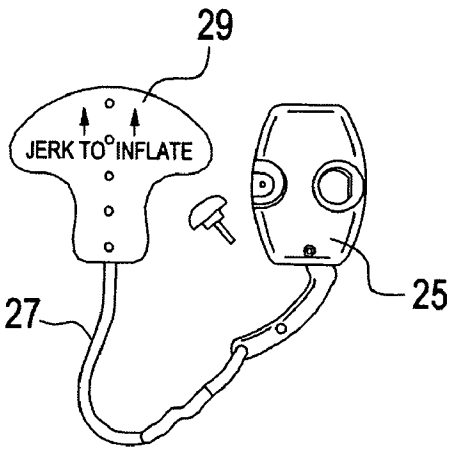
FIG. 10 shows the inflator used with the present invention.

As seen for example in FIGS. 1 and 8, a plurality of straps 33 are provided, one at each corner of the pod 10, so that they may be looped over the corners of the mattress 3 in a similar manner as a fitted sheet to mount the pod 10 on top of the mattress 3 in a manner retaining it in position thereon.

With reference to FIGS. 1, 2 and 8, when the zippers 15 and 18 are opened, the portions 24, 26 (FIG. 6) of the pod 10 contained within the chamber 22 enclosed by the cover 11 and closed by the zipper become accessible. As shown in FIG. 8, these portions include the side portions 35 and 37. These side portions 35 and 37 include integrally included handles 39 which in the preferred embodiment comprise two handles 39 on each side portion. Additionally, one of the side portions has connected thereto straps 41 which may be extended as shown in FIG. 8 over a person 7 and may be fastened to the other side portion using a coupling 42 (FIG. 11) with the effect as shown in FIG. 8 that the side portions 35 and 37 are retained in an upward configuration enclosing the person 7 with the straps 41 preventing the person 7 from leaving the pod 10.

Figure 5:
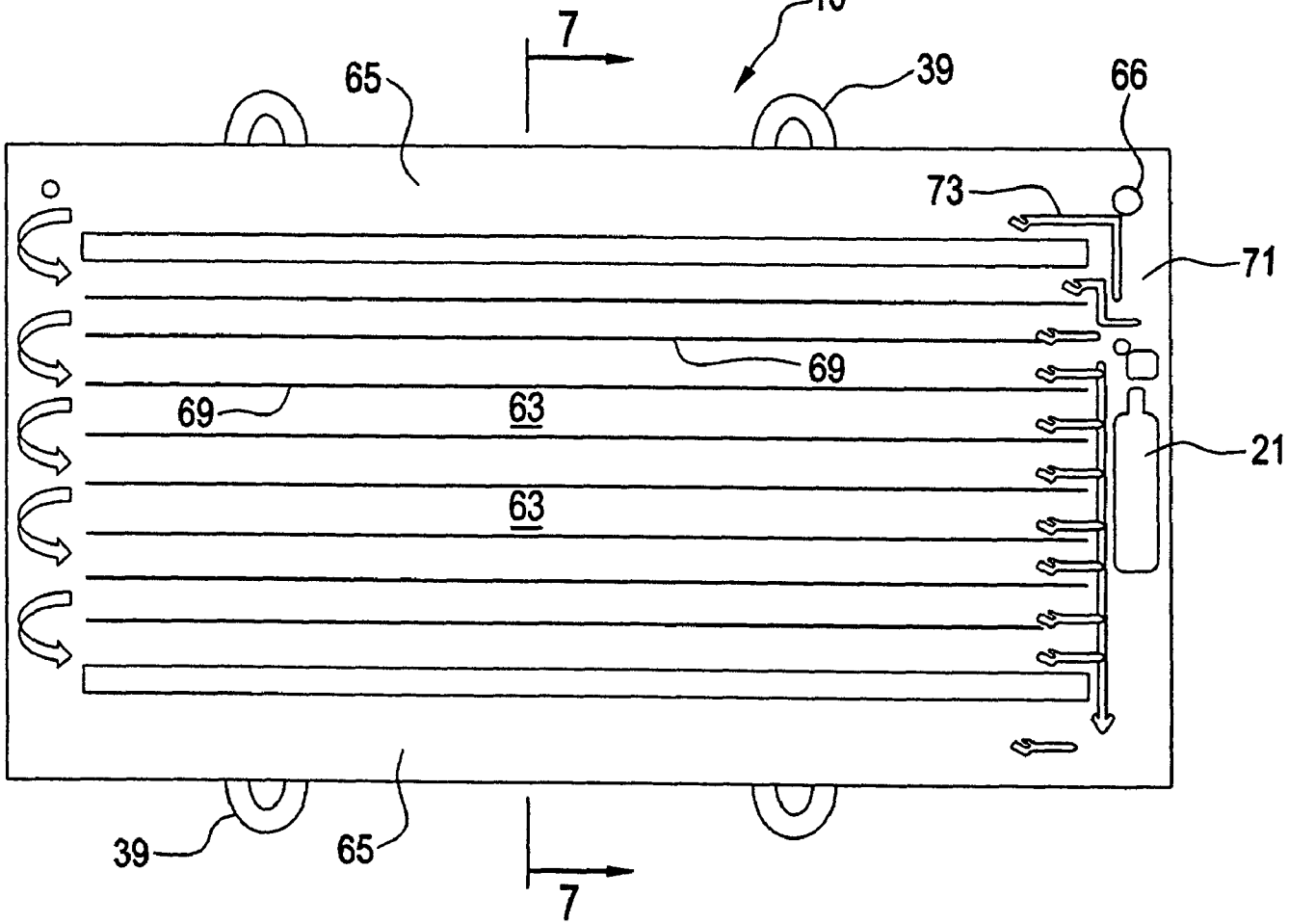
FIG. 5 shows a top view of the invention.
Figure 6:
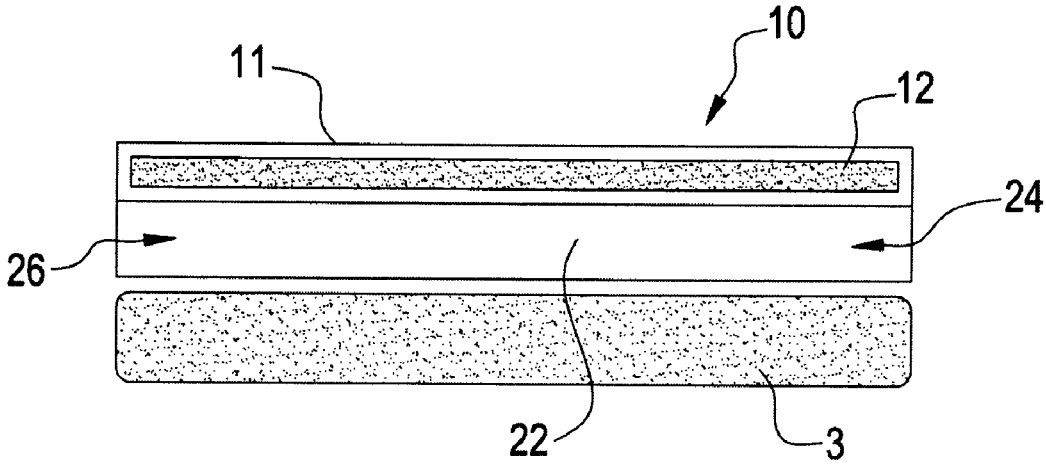
FIG. 6 shows a cross-sectional view along the line 6-6 of FIG. 1.

With reference to FIGS. 5 and 7, in the preferred embodiment of the present invention, there are eleven elongated air bladders including, as shown, nine air bladders 63 on the underside of the device 10 and two air bladders 65 on each side of the device 10. Between each air bladder 65 and the set of air bladders 63, a dead space 67 is provided which facilitates fluid interconnection between the bladders 63 and 65 for inflation purposes, but also permits the bladders 65 to extend over the sides of the device 10. The handles 39 are affixed to the bladders 65.

As shown in FIGS. 5 and 7, all of the bladders 63 and 65 are interconnected with one another so that when the cylinder 21 releases gas upon pulling the handle 29 and cord 27, all of the bladders 63 and 65 inflate simultaneously. The lines 69 in FIG. 5 schematically represent welds in the material that create the separate bladders 63. As shown, in particular, in FIG. 5, the cylinder 21 is located within a manifold 71 which fluidly connects the gas outlet to all of the bladders 63 and 65 simultaneously as depicted by the arrows 73.

Once the side portions 35 and 37 have been deployed as shown in FIG. 8 and the straps 41 have been configured as shown in FIG. 8, the cord 27 may be pulled by gripping the handle 29 to open the valve 25 and cause gas from the cylinder 21 to fill up the internal chambers of the evacuation pod 10 including chambers contained within the side portions 35 and 37 as well as chambers in the portion of the pod 10 underlying the person 7 so that a buoyant inflated evacuation pod 10 configuration is achieved. The cylinder 21 has sufficient capacity that it will contain plenty of gas to facilitate more than complete filling and pressurization of the pod 10. In order to avoid overfilling, a pressure relief valve 66 is incorporated into the fluid circuit. The pressure regulator senses the pressure within the chambers of the pod 10 and when that pressure arrives at a pre-set threshold, further pressurization results in closing of the valve 25 to cut off the flow of gas from the cylinder 21 to the chambers.

Figure 9:
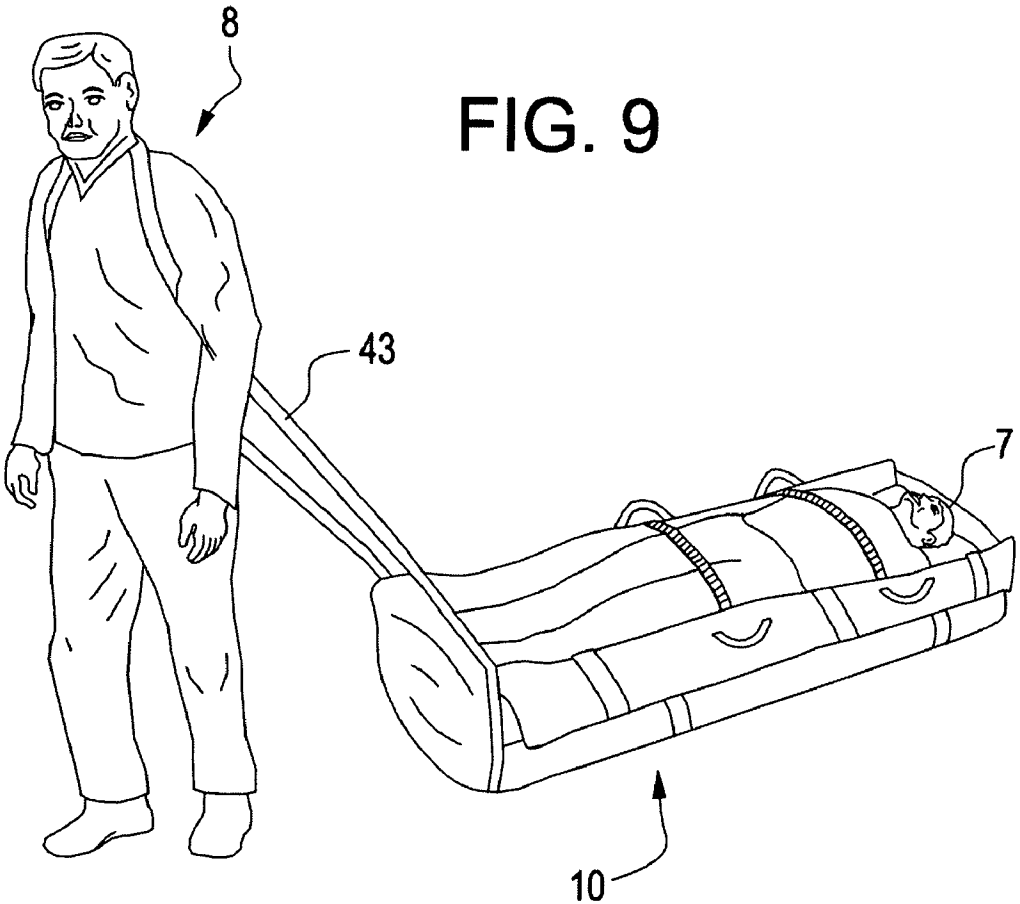

With reference to FIG. 9, the evacuation pod 10 includes an elongated transport strap 43 that may be looped over the shoulders of a person 8 to facilitate dragging the pod 10 with a person 7 thereon to a safe location. If the person 8 encounters water, the buoyancy of the pod 10 will allow it to float over the surface of the water without endangering the person 7.

Figure 12:
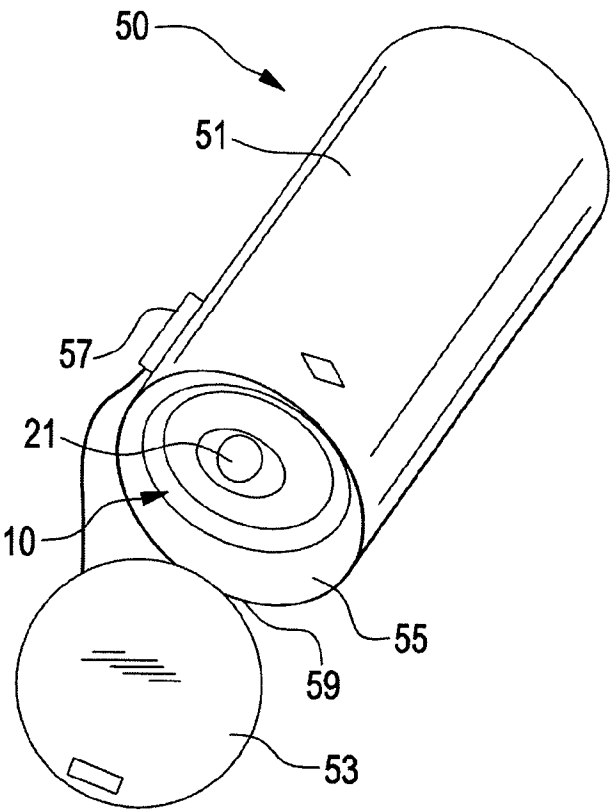
FIG. 12 shows a second embodiment of the present invention comprising a wall unit.
Figure 11:
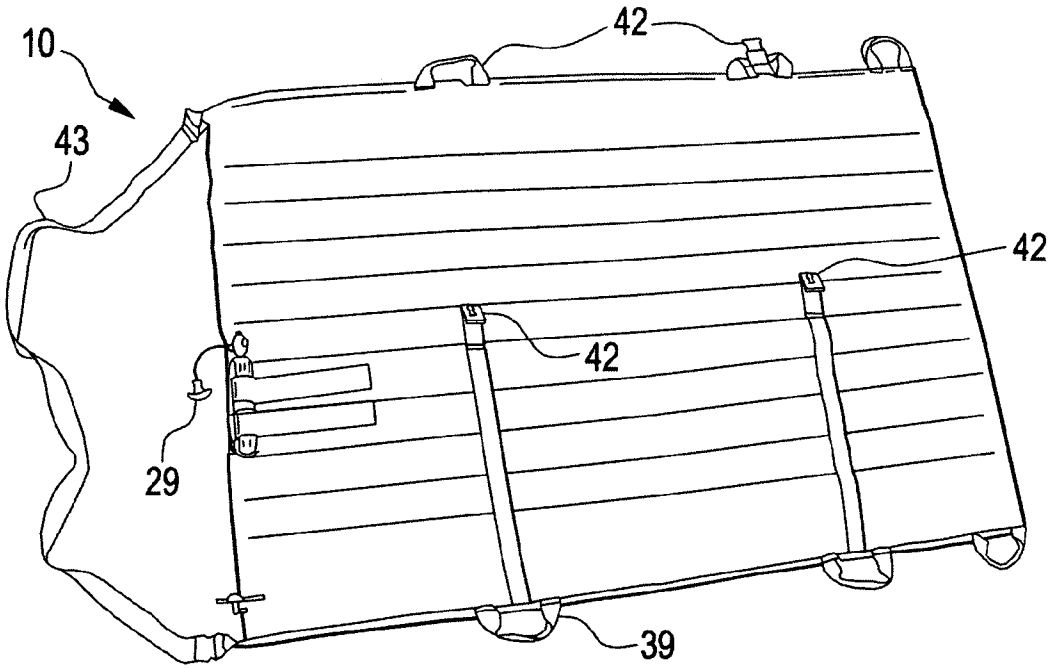
FIG. 11 shows a further top view of the invention.

With reference to FIG. 12, a second embodiment of the present invention is designated by the reference numeral 50 and is seen to include the universal evacuation pod 10, but stored within a cylinder 51 having a removable cap 53. The universal evacuation pod 10 shown rolled up in FIG. 12 and contained within the canister 51 has the same structures as those of the universal evacuation pod 10 illustrated in FIGS. 1-11. When it is desired to deploy the pod 10 shown in FIG. 12, the cap 53 is removed from the opening 55 in the canister 51 and is removed therefrom, unrolled, and deployed in a manner that should be well understood by those of ordinary skill in the art given the description accompanying FIGS. 1-11. If desired, an audible alarm 57 may be provided that is activated when the cover 53 is opened. If desired, the cover 53 may be removed from the canister 51 to expose the opening 55 or may have hinges at 59 facilitating pivoting of the cover 53 in the manner shown in FIG. 5.

In the preferred embodiments of the present invention, the cover 11 of the pod 10 may be made of a material such as nylon having a polyurethane coating. The nylon may be of a 400 Denier level of quality.

The carrying handles 39, best seen in FIG. 3, may be made of nylon webbing, for example, 2 inches wide. The straps 33 may, if desired, comprise elastic strap retainers to ensure the pod 10 remains in place on top of the mattress 3.

The cartridge or cylinder 21 may have any desired capacity so long as the capacity is sufficient to ensure complete filling of the interior chambers of the pod 10. A 220 G $CO_2$ cartridge is suitable for this purpose. The valve 25 may, if desired, be a Halkey-Roberts 840 Rapid Inflation Valve, that inflates the chambers of the pod 10 to a desired pressure level. Once that pressure level has been achieved, the pressure relief valve 66 (FIG. 5) opens with any additional gas flow to keep the pressure level within desired limits. One set of uninflated dimensions for the inventive pod 10 could, if desired, be 56 inches by 80 inches, although other dimensions would be acceptable and fall within the teachings of the present invention. The canister 51 may be made of a strong material such as polyvinylchloride (PVC) and the lid 53 may be made of the same or similar material.

In the operation of the pod 10 as mounted on a bed 3, first, the elastic straps 33 may be removed from the mattress 3. Then, the zippers including the zipper 15 and the zipper on the side 17 are opened and the side portions 35 and 37 are removed from within the chamber of the pod by pulling the handles 39. Then, the handle 29 is gripped and the cord 27 is pulled to open the valve 25 and allow gas from the cylinder 21 to inflate the interior chambers of the pod 10. If, for any reason, the system does not inflate, the cylinder 21 may be removed and a secondary inflation source may be coupled to the opening provided to inflate the system. When the pressure relief valve 66 senses sufficient pressure within the chambers of the pod 10, it opens upon sensing overinflation, and, if desired, an audible and/or visual alarm is activated so that emergency personnel will be aware that the pod 10 is completely inflated and ready to use as an evacuation device.

Concerning inflation of the pod 10, when the handle 69 is pulled, thereby pulling the cord 27, the valve in fact is a puncture device that punctures a thin area at the throat of the cylinder 21 to allow gas to be released. The amount of gas that is released varies based upon ambient temperature. Overinflation is prevented through the use of a pressure relief valve which is RF welded to the opposite side of the inflation assembly. When the inflation pressure of the pod 10 reaches the desired level, for example, six psi plus/minus 0.5 psi, the pressure relief valve 66 is opened to prevent overinflation. If, for any reason, the pressure in the pod reduces to, for example, 4.4 psi plus/minus 0.5 psi, the pressure relief valve 66 will re-seat itself to stop gas leakage. The audible alarm (not shown) is useful in the event of a malfunction in the inflation process requiring manual inflation. If manual inflation becomes necessary, the audible alarm may be designed to activate when the pod 10 reaches fill capacity and gas or air begins to bleed off through the relief valve 66.

The various straps including those used to retain a patient on the pod 10 and those used to pull the patient may, if desired, comprise two inch nylon webbing having a minimum tensile strength of 1000 pounds. In the preferred embodiment, the straps are sewn to the pod 10 in a suitable manner.

Once the pod 10 is completely inflated, the straps 41 are placed across the chest of the person or patient 7 and then tightened. This ensures that the person or patient 7 remains within the confines of the pod 10. The handles 39 are then employed to lift the pod off the bed mattress 3 and onto a floor surface. Thereafter, straps including the strap 43 (FIG. 4) are utilized to evacuate the person or patient 7. The handles 39 may also be employed for this purpose.

The wall mounted pod system 50 operates in the same manner as the pod 10 with the exception that it must be removed from the canister 51, placed on a floor surface, unrolled to a flat configuration, and thereafter the steps of deployment and use are the same as those for the pod 10 as illustrated in FIGS. 1-4.

Accordingly, an invention has been disclosed in terms of preferred embodiments thereof which fulfill each and every one of the objects of the invention as set forth hereinabove, and provide a new and useful universal evacuation pod of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

The invention claimed is:

1. An evacuation pod, comprising:

a) an elongated body having relatively shorter end walls and relatively longer side walls, a top surface connected to said side walls, each of said side walls including an opening facilitating access to an internal storage chamber, each opening being closed when said pod is not in use, and opened for use;

b) lateral portions on each side of said pod being stored in said storage chamber when said pod is not in use and said portions being laterally extendable through said openings for use;

c) at least one inflatable chamber within said pod;

d) inflation means for inflating said pod including inflating said lateral portions;

e) a plurality of gripping handles on said pod to facilitate transporting said pod;

f) at least one strap attached at one of said end walls to facilitate transporting said pod; and g) at least one further strap interconnecting said lateral portions when inflated to retain said lateral portions in an upward configuration enclosing a person therebetween.

2. The pod of claim 1, wherein said top surface includes padding.

3. The pod of claim 1, including four corners, and a yet further strap at each corner for releasably attaching said pod over a mattress.

4. The pod of claim 1, wherein each side wall opening is closeable by a fastener chosen from the group consisting of a zipper, a hook and loop fastener, buttons and snaps.

5. The pod of claim 1, wherein said gripping handles are on said lateral portions.

6. The pod of claim 5, comprising two gripping handles on each lateral portion.

7. The pod of claim 1, wherein said inflation means comprises a gas cylinder fluidly connected to said at least one inflatable chamber.

8. The pod of claim 7, wherein a valve is interposed between said cylinder and said inflatable chamber.

9. The pod of claim 8, further including a pressure regulator that senses gas pressure in said inflatable chamber and closes said valve when said pressure achieves a desired pre-set level.

10. The pod of claim 9, further including an audible alarm activated when said pressure regulator closes said valve.

11. The pod of claim 1, wherein said pod is generally rectangular.

12. The pod of claim 1, wherein said lateral portions include a plurality of straps usable to interconnect said lateral portions to enclose a person therebetween.

13. The pod of claim 1, wherein said at least one strap is made of NYLON.

14. The pod of claim 13, wherein said handles are made of NYLON.

* * * * *